US006321758B1

(12) United States Patent
Sturgill et al.

(10) Patent No.: US 6,321,758 B1
(45) Date of Patent: Nov. 27, 2001

(54) TOBACCO LEAF HANDLING ASSEMBLY

(75) Inventors: James D. Sturgill, Cheraw; Donald J. Stewart, Bennettsville, both of SC (US)

(73) Assignee: Powell Manufacturing Company, Bennettsville, SC (US)

( * ) Notice: Subject to any disclaimer, the term of this patent is extended or adjusted under 35 U.S.C. 154(b) by 0 days.

(21) Appl. No.: 09/325,549

(22) Filed: Jun. 4, 1999

Related U.S. Application Data

(60) Provisional application No. 60/088,118, filed on Jun. 4, 1998.

(51) Int. Cl.[7] ..... A24B 1/04; A24B 3/10; B60P 1/00

(52) U.S. Cl. ..... 131/327; 131/110; 131/290; 414/502; 414/507; 414/508

(58) Field of Search ..... 131/290, 311, 131/312, 110, 108, 109.2, 327, 304, 306; 414/502, 507, 508; 56/27.5

(56) References Cited

U.S. PATENT DOCUMENTS

| | | | | |
|---|---|---|---|---|
| 2,873,747 | * | 2/1959 | Schlossmacher | 131/327 |
| 4,018,674 | * | 4/1977 | Morris | 209/539 |
| 4,026,431 | * | 5/1977 | Long | 414/502 |
| 4,379,669 | * | 4/1983 | Wilson | 414/21 |

* cited by examiner

*Primary Examiner*—Stanley S. Silverman
*Assistant Examiner*—Dionne A. Walls

(74) *Attorney, Agent, or Firm*—Pillsbury Winthrop LLP

(57) ABSTRACT

The present invention relates to a method for transferring harvested tobacco leaves from an amorphous mass of harvested tobacco leaves to a bulk curing container component for subsequent transfer to a bulk curing site. According to the method, the bulk curing container component is positioned adjacent a tobacco discharging end of a tobacco transferring system. The transferring system has the discharging end, a tobacco receiving end opposite the discharging end, and a generally upwardly facing tobacco conveying apparatus for supporting and moving the leaves between the discharging and receiving ends. The amorphous mass of harvested tobacco leaves is supplied to the tobacco conveying apparatus at the tobacco receiving end of the transferring system in such a manner that the harvested tobacco leaves of the amorphous mass are randomly arranged and stacked on top of one another in a generally vertical direction. The transferring system is continuously operated under power such that the transferring system (a) conveys the harvested tobacco leaves from the tobacco receiving end thereof to the tobacco discharging end thereof and then subsequently discharges the conveyed tobacco leaves to the bulk curing container component, and (b) separates the leaves from one another and disperses the separated leaves along the tobacco conveying apparatus as the leaves are being conveyed to thereby reduce the aforesaid vertical stacking of the harvested leaves so that substantially all the leaves being discharged into the bulk curing container component from the discharging end thereof are separated from one another. The present invention also relates to a tobacco transferring system.

11 Claims, 4 Drawing Sheets

TOBACCO LEAF HANDLING ASSEMBLY

The present application claims priority to U.S. Provisional Patent Appln. No. 60/088,118, filed Jun. 4, 1998, the entirety of which is incorporated into the present application by reference.

FIELD OF THE INVENTION

The present invention relates to tobacco leaf handling and more particularly to an assembly and method for transferring a large amorphous mass of harvested tobacco leaves from a collection receptacle in which they are collected during harvesting to a bulk curing container component.

BACKGROUND OF THE INVENTION

Some types of tobacco such as bright leaf or flue-cured tobacco are harvested by removing selected individual leaves from tobacco plants growing in a tobacco field. Typically the individual tobacco leaves are placed in a container component after removal from the tobacco plant where they are collected in bulk for transfer to a drying and curing facility for further processing.

Traditionally tobacco leaves were harvested manually and prepared for curing by manually tying the individual tobacco leaves in groups or hands comprising three to eight leaves. Each hand was then typically supported by tying the butt ends of the leaves of the hand together with a string and supporting successive interconnected hands on an elongated stick. A plurality of such sticks with the groups of leaves supported thereon were placed in a curing barn so that the leaves were exposed to curing air with the barn.

This traditional stick barn method of curing tobacco was slow and labor intensive. A method and apparatus for bulk curing whole leaf, flue-cured tobacco was described in U.S. Pat. No. 3,105,713 issued Oct. 1, 1963 and U.S. Pat. No. 3,110,326 issued Nov. 12, 1963 to F. J. Hassler, which patents are hereby incorporated into the present application in their entirety. These references disclose a tobacco curing rack and method of aligning tobacco leaves therein so that the racked leaves are essentially parallel, the tobacco stalks are pointing in the same general direction and the leaves form a single tier which is approximately one leaf length high. This single tier type of bulk curing rack is sometimes referred to as a conventional bulk curing rack and, although it represents an improvement over the traditional stick barn method, this type of curing rack has a relatively small leaf capacity and is relatively difficult to fill with leaves because the leaves must be carefully aligned and generally parallel within these conventional curing racks.

In the middle of 1970s a box-type tobacco curing rack came into existence which does not require the whole leaf tobacco to be arranged into single tiers. Tobacco leaves instead are arranged therein with the leaves generally open and flat, the leave surfaces generally parallel and the leaves uniformly distributed therein. When tobacco leaves are placed in a box-type rack, they are typically placed therein with their leaf surfaces parallel to the ground and when the box type rack is full of leaves, a cover is placed thereover and the rack is placed in a curing barn such that the leaf surfaces are generally vertical. Then, heated and conditioned air is forced through the leaves to cure the same. Accordingly, box-type tobacco racks, also referred to as tobacco curing bins, are typically large, generally rectangular boxes which operate in two general orientations: 1) an open, generally horizontal orientation in which the rack is filled with leaves and 2) a closed, generally vertical orientation which supports the leaves therein in proper position for curing and drying.

It is well-known that uniform distribution of the tobacco leaves within a curing bin is essential in bulk curing of tobacco. The individual tobacco leaves must be loaded compactly in a curing bin without voids so that during bulk curing, the heated and conditioned air that is forced between the leaves will flow uniformly therethrough without the air flow concentrating within voids. The advent of these box-type tobacco curing bins in the 1970's presented an opportunity to significantly automate the handling of tobacco from tobacco harvesting through processing and to reduce the manual labor traditionally associated therewith because these bins made it possible to prepare large numbers of leaves for the curing barn at one time. Mechanical harvesting of tobacco leaves was well known in the 1970's which permitted the initial harvesting of leaves from the field in bulk.

Mechanical harvesting of individual whole tobacco leaves was in use in the 1960s which reduced the need to manually harvest tobacco leaves. Typically tobacco leaf harvesting on large farms is performed by a specialized tobacco combine or, on smaller farms, with a mechanical tobacco harvesting implement attached to a conventional tractor. A tobacco combine is typically comprised of a plurality of mechanical power driven defoliating units which remove a swath or preselected series of leaves from each plant in at least one row of tobacco at a time as the combine moves along the rows. Often the preselected leaves are removed from the bottom of each plant as the leaves become mature during the growing season. Examples of combines including single row and double row combines are found in U.S. Pat. No. 3,772,862 issued Nov. 20, 1973 to Robert W. Wilson; U.S. Pat. No. 4,178,745 issued Dec. 18, 1979 to Robert W. Wilson; and U.S. Pat. No. 4,476,669 issued Oct. 16, 1984 to Robert W. Wilson, which patents are hereby incorporated by reference into the present application in their entirety.

As described fully in the incorporated patent references '862,'745, U.S. Pat. No. 4,476,669, the defoliator units strip leaves from the plants and delivers the same to a plurality of conveyor assemblies which cooperate to move the leaves upwardly and rearwardly above an elevated platform on the combine on which a suitable leaf collection receptacle is mounted. Upwardly extending sections of a conveyor assembly discharge the leaves into the leaf receptacle. The conveyor assembly frequently deposits the leaves directly in the receptacle as an amorphous mass. The leaves are therefore randomly arranged, the leaf surfaces are not parallel and the leaves are not uniformly packed or uniformly distributed within the receptacle. Leaves at the bottom of the receptacle are subject to the accumulated weight of the leaves in overlying relation therewith within the receptacle and, because the receptacle is supported on a moving vehicle, the dynamic forces on the overlying leaf mass may compress or pack the leaves at the bottom of the leaf collection receptacle somewhat. Contemporary mechanical combines are capable of harvesting large masses of leaves in a short period of time. Some mechanical harvesters typically harvest 4,000 to 8,000 pounds of tobacco leaves per hour.

This mechanization has reduced tobacco harvesting labor costs but has created the problem of how to transfer the large amorphous mass of tobacco leaves from the leaf collection receptacle on the combine to tobacco curing bins or tobacco racks for further tobacco processing. Stated another way, it can be appreciated that the tobacco combine and various dedicated harvesting implements for conventional tractors have enabled tobacco farmers to quickly harvest large quantities of leaves with relatively little labor; large capacity curing bins provide a way to economically transfer large quantities of tobacco leaves to the curing barn. A persistent problem facing tobacco farmers, however, is how to transfer quickly and with relatively few workers large quantities of amorphous masses of tobacco leaves gathered in the tobacco field to the large capacity curing bins.

One solution to this problem is to distribute the harvested leaves directly into a curing bin or rack that is mounted on the combine. An example for the former approach is illustrated in the above incorporated '745 United States reference. This approach offers many advantages. For example, the '745 reference discloses a method and apparatus for mechanically distributing tobacco leaves directly into a curing bin without additional manual labor. This reduces labor costs and enables the tobacco grower to send the leaves directly from the combine to the curing barn.

It may be desirable, however, to collect the harvested leaves in a separate collection receptacle in a first step and then transfer them to a curing bin or rack in a second step. One reason may be weight. Very large curing bins are in use, an example of which is disclosed in U.S. Pat. No. 4,136,465 issued Jan. 30, 1979 to Robert W. Wilson which patent is hereby incorporated by reference into the present application in its entirety. The curing bin in the '465 reference is also a section of the curing barn; it may be advantageous to fill this size curing bin in a second step as opposed to filling it directly on the combine in a manner described, for example, in the '745 reference. Were such a large curing bin to be mounted on a combine, this may result in undesirable combine wheel load, particularly if the ground is wet or the soil is soft.

It may also be desirable to combine tobacco leaves from different sources in one curing bin or rack for curing. Tobacco growers with small acreage, for example, may not harvest leaves with a combine. The leaves may be delivered for drying and curing in sheets. These so-called "sheeted leaves" are typically hand picked and placed on a sheet which is folded thereabout and tied for transport. It may be desirable to use a separate second step to fill the tobacco curing bins to accommodate tobacco from a plurality of sources.

Consequently, a need exist for a method and assembly for transferring a large amorphous mass of harvested tobacco leaves to a curing rack or curing bin for drying and curing.

SUMMARY OF THE INVENTION

One aspect of the present invention provides a method for transferring uncured substantially whole harvested tobacco leaves from an amorphous mass of harvested uncured substantially whole tobacco leaves contained in a tobacco containing structure to a bulk curing container component for subsequent curing. The method includes positioning the bulk curing container component adjacent a tobacco discharging end of a tobacco transferring system, the transferring system having the discharging end, a tobacco receiving end opposite the discharging end, and a generally upwardly facing tobacco conveying apparatus for supporting and conveying the leaves between the discharging and receiving ends thereof. The method further includes supplying the amorphous mass of harvested uncured substantially whole tobacco leaves from the tobacco containing structure to the tobacco conveying apparatus at the tobacco receiving end of the transferring system in such a manner that the harvested uncured substantially whole tobacco leaves of the amorphous mass are randomly arranged and in a vertically stacked condition on top of one another. The method further include continuously operating the transferring system under power such that the transferring system (a) conveys the harvested uncured substantially whole tobacco leaves from the tobacco receiving end thereof to the tobacco discharging end thereof and then subsequently discharges the conveyed uncured substantially whole tobacco leaves from the discharging end thereof to the bulk curing container component with the tobacco conveying apparatus supporting and conveying the harvested uncured substantially whole tobacco leaves supplied thereto in the vertically stacked condition away from the tobacco receiving end at a first speed and (b) separates the uncured substantially whole tobacco leaves supplied in the vertically stacked condition and disperses the uncured leaves along the tobacco conveying apparatus as the leaves are being conveyed thereby to reduce the vertically stacked condition of the uncured leaves so that the uncured leaves are discharged from the discharging end thereof as a substantially continuous stream of uncured substantially whole tobacco leaves in a separated condition moving at a final speed greater than the first speed.

It can be appreciated that the method of the present invention reduces the need for laborers to manually separate the leaves as they are removed from the amorphous mass because the transferring system is operated so as to provide separation and dispersion between the leaves. Although it is contemplated that some manual labor will be used to ensure a proper transfer of the leaves from the amorphous mass to the transferring system, the ability of the transferring system reduces the need for numerous laborers to manually separate the leaves.

Another aspect of the present invention provides a mechanized tobacco transferring system for performing a tobacco transferring operation wherein a plurality of harvested tobacco leaves are transferred from an amorphous mass of harvested tobacco leaves to a bulk curing container component for subsequent transfer to a bulk curing site. The mechanized tobacco transferring system of this aspect of the invention comprises a power-operated tobacco conveying apparatus having a tobacco receiving end, a tobacco discharging end, and a generally upwardly facing tobacco receiving surface between the receiving and discharging ends. The conveying apparatus is constructed and arranged to convey harvested tobacco leaves from the amorphous mass from the receiving end to the discharging end thereof during the tobacco transferring operation with the tobacco supporting surface supporting the harvested tobacco leaves as the leaves are being conveyed. A power-operated tobacco separating device is associated with the tobacco conveying apparatus. The tobacco separating device is constructed and arranged to engage the tobacco leaves as they are being conveyed during the tobacco transferring operation so as to encourage separation between the harvested leaves. The tobacco separating device and the tobacco conveying apparatus are constructed and arranged to operate in cooperation with one another during the tobacco transferring operation such that the amorphous mass of harvested tobacco leaves can be disposed on the upwardly facing tobacco supporting surface at the conveying apparatus' tobacco receiving end in such a manner that the leaves are randomly arranged and stacked on top of one another in a generally vertical direction. Then, the conveying apparatus and the separating device can be operated under power so as to (1) convey the harvested tobacco leaves from the tobacco receiving end of the conveying apparatus to the tobacco discharging end and then subsequently discharge the conveyed tobacco leaves to the bulk curing container component, and (2) separate and disperse the harvested leaves of the amorphous mass along the tobacco supporting surface as the leaves are being conveyed to thereby reduce the aforesaid vertical stacking of the harvested leaves so that substantially all the leaves being discharged into the bulk curing container component from the discharging end thereof are separated from one another.

Other objects, features, and advantages of the present invention will become apparent from the following detailed description, the accompanying drawings, and the appended claims.

DETAILED DESCRIPTION OF THE PREFERRED EMBODIMENT OF THE INVENTION

Figure 1:
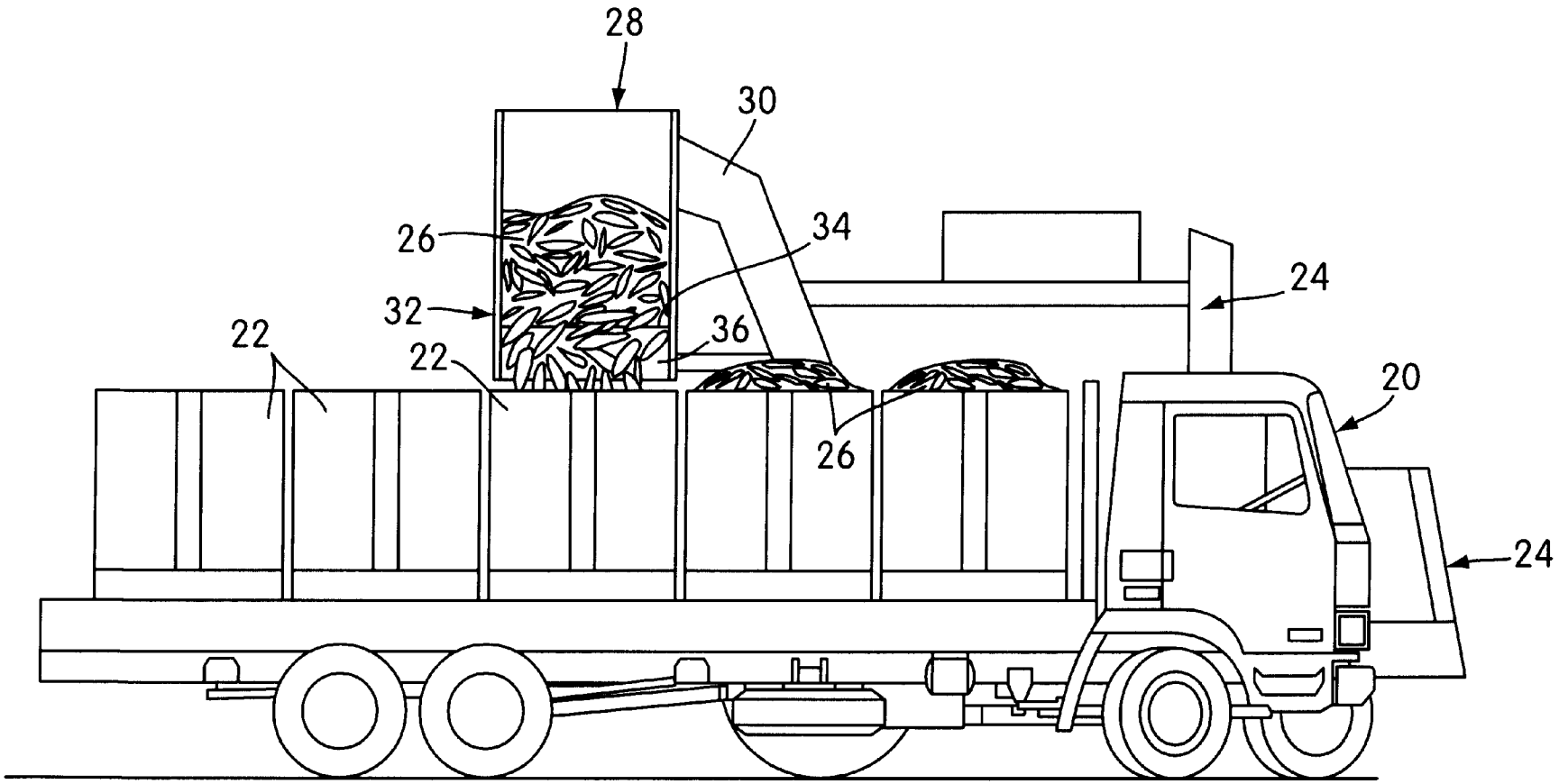
FIG. 1 is an elevational view of a tobacco combine transferring a plurality of tobacco leaves harvested in bulk from a collection receptacle on the combine to a conventional wooden crate structure supported on a conventional flat bed truck.

Referring now more particularly to the drawings, there is shown in FIG. 1 a conventional flat bed truck 20 supporting a plurality of conventional wooden crate structures 22. A conventional combine 24 for harvesting a plurality of individual tobacco leaves in bulk is shown transferring an amorphous mass of harvested individual whole tobacco leaves 26 from a collection receptacle 28 mounted on a rearward portion of the combine 24 into a preselected wooden crate structure 22. The combine 24 represents any commercially available combine or harvester and can represent, for example, an embodiment of a combine disclosed in the above incorporated U.S. Pat. No. 4,476,669 patent reference, the '745 patent reference or the '862 patent reference.

In the combine 24 shown in FIG. 1, the tobacco leaves 26 are transported rearwardly and upwardly into the collection receptacle 28 by a plurality of conveyor assemblies 30 in a manner described in the above disclosed and incorporated patent references and will not be repeated here. Although a leaf distributing mechanism as disclosed in the '745 reference could be included in the combine 24 to arrange uniformly the tobacco leaves within suitable container in a manner appropriate for immediate transfer to a curing barn for curing, such a mechanism and such container is not included in the combine 24 shown in FIG. 1. Consequently, the collected leaves 26 generally have random orientation and uneven distribution so that the leaves form a relatively, but generally not uniformly dense, amorphous mass.

When the collection receptacle 28 is full, the tobacco leaves 26 are transferred to a wooden crate structure 22 by a transverse conveyor assembly, generally designated 32, incorporated into the collection receptacle 28. The transverse conveyor assembly 32 is comprised of a transversely extending first conveyor portion 34 which forms the leaf support bottom surface of the collection receptacle 28 and a second conveyor portion 36 which is pivotally mounted along a bottom edge of the receptacle 28 for pivotal repositioning with respect thereto between two general positions: 1) a vertical first position and 2) a downwardly and outwardly pivoted second position. In the vertical first position (not shown), the second conveyor portion 36 forms a side wall portion of the collection receptacle 28; the second conveyor portion 36 pivots transversely outwardly and downwardly to the second position shown in FIG. 1 to form a downwardly inclined conveyor ramp to remove the leaves from the collection receptacle 28. Preferably each crate structure 22 is dimensioned to receive the entire contents of a full collection receptacle 28 so that a single leaf load from the combine 24 fills a single crate structure 22.

The collection receptacle 28 is emptied of leaves 26 by rotating a conventional conveyor belt mounted on the conveyor portions 34, 36. Each conveyor belt on each conveyor belt portion 34, 36 is independently operable through conventional controls located remote from the receptacle 28. When the contents of the receptacle 28 are transferred to a crate structure 22, the combine returns to the field to continue harvesting tobacco leaves. Typically the flat bed truck 20 is parked in or near the tobacco field and is periodically repositioned to remain proximate the combine during the harvest.

One skilled in the art will appreciate that when the collection receptacle 28 is full, the leaves are typically randomly oriented therein and may be tightly packed. The packing can occur, for example, at the bottom of the leaf mass in the receptacle because the accumulated weight of the leaf mass exerts a compressing force on the leaves at the bottom of the receptacle.

Figure 2:
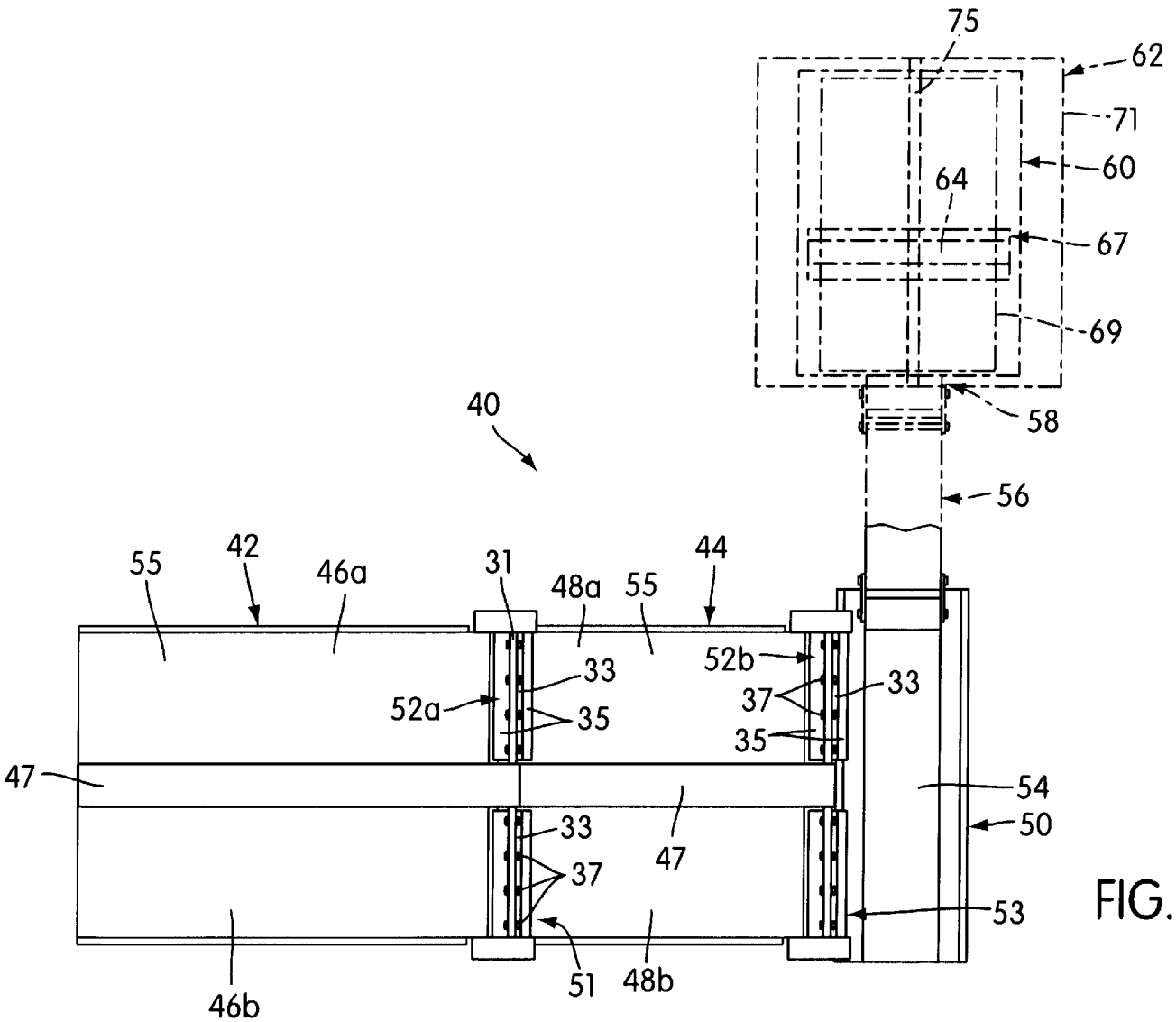
FIG. 2 is a partially schematic top plan view of a tobacco processing assembly constructed and arranged according to the principles of the present invention for transferring an amorphous mass of harvested tobacco leaves to a conventional tobacco curing bin showing a portion of a tobacco processing apparatus, a mechanical leaf distribution mechanism and the tobacco curing bin schematically in phantom lines.

When the crate structures 22 are filled or the harvest is complete, the flat bed truck 20 carries the crate structures 22 to a tobacco transferring assembly or system, generally designated 40, and shown in plan view in FIG. 2, where the tobacco leaves 26 are transferred to appropriate containers for subsequent drying and curing. A portion of the tobacco transferring assembly 40 is shown schematically in FIG. 2.; the schematic portion of FIG. 2 is shown in phantom lines. The tobacco transferring assembly 40 is used to transfer the amorphous mass of tobacco leaves 26 to a tobacco rack or, preferably, to a curing bin. As mentioned above, in the exemplary embodiment of the tobacco transferring assembly 40 shown in the figures, a curing bin is shown, but one skilled in the art will understand that this is illustrative and not intended to be limiting. The tobacco transferring assembly 40 includes a first conveyor assembly 42 and a second conveyor assembly 44 which are longitudinally aligned as shown in FIG. 2. The first and second conveyor assemblies 42, 44 may include identical structural features and may have the same or different dimensions. Identical structures on each conveyor assembly 42, 44 are given identical reference numbers and may be given an additional letter designation for reference purposes only to facilitate the discussion of the structure and operation of the tobacco transferring assembly 40.

Each conveyor assembly 42, 44 includes a plurality of conventional conveyor belt structures generally designated 46*a,* 46*b,* 48*a,* 48*b* which cooperate to move the tobacco leaves 26 towards a tobacco handling apparatus, generally designated 50. The tobacco handling apparatus 50 is shown partially in phantom lines in FIG. 2. The conveyor belt structures 46*a,* 46*b* on the conveyor assembly 42 are rotated in a conventional way as, for example, by a conventional first drive means (not shown) and the conveyor belt structures 48*a,* 48*b* on the second conveyor assembly 44 are operated by a conventional separate second drive means (not shown) so that the conveyor belt structures 46*a* and 46*b* rotate together and the conveyor belt structures 48*a* and 48*b* rotate together but the conveyor belt structures 46 and 48 operate independently of one another. The first and second drive means can be any conventional power source such as an electric or internal combustion engine, or, alternatively, an independent clutch mechanism associated with each conveyor assembly 42, 44 coupled to a single conventional power source.

More specifically, the respective conveyor assemblies 42, 44 can be provided with separate motors or, alternatively, both 46, 48 can be driven by the same motor and provided with appropriate clutching mechanisms to provide independent rotational operation of each conveyor belt structure 46, 48.

Each conveyor assembly 42, 44 is provided with two conventional conveyor belt structures 46*a,* 46*b* and 48*a,* 48*b,* respectively, that rotate in pairs as a single conveyor unit. Although each pair, including the first pair 46*a,* 46*b* and the second pair 48*a,* 48*b* could be replaced by two large conveyor belts, two belts are provided on each assembly 42, 44 so that a person can stand on a center portion 47 of the assembly 42 or 44, if desired.

Each conveyor assembly 42, 44 is provided with a transversely mounted paddle structure 52, each of which rotates about a transversely extending axle 31 at the leaf discharge ends, generally designated 51 and 53, respectively, of the respective conveyor assemblies 42, 44. Each axle 31 extends across approximately the entire width of the respective conveyor assembly. The axle 31 of each paddle structure 52*a,* 52*b* is provided with a plurality of circumferentially spaced flanges 33 which extend the length of the axles 31. A blade member 35 is secured to each flange 33 by a plurality of conventional rivets 37. Each paddle structure 52 can be gear or belt driven by the respective drive means for each conveyor assembly 42, 44 to effect the rotation thereof about their respective transverse axes when the conveyor belt structures 46, 48 associated therewith are rotating. As will be explained in greater detail hereinbelow, the tobacco transferring assembly 40 generally operates by placing an amorphous mass of relatively dense tobacco leaves 26 on the first conveyor assembly 42 and manually spreading the tobacco leaves 26 over the conveyor belt surface 55 of the moving conveyor belt structures 46*a,* 46*b*. The leaves are discharged by the paddle structure 52*a* onto the second conveyor assembly 44 which advances the same toward the second paddle structure 52*b* which, in turn, discharges the tobacco leaves 26 in a manner described hereinbelow into the tobacco handling apparatus 50.

The tobacco handling apparatus 50 is shown partially schematically in FIG. 2 because this apparatus 50 has been completely disclosed and described in the U.S. Pat. No. 4,379,669 and this patent is incorporated by reference into the present application in its entirety. Consequently, a discussion and illustration of the details of the structure and the operation of the tobacco handling apparatus 50 will not be repeated in the present application. A few important structures of the tobacco handling apparatus 50 will, however, be pointed out so that the structure and operation of the tobacco processing assembly 40 of the present invention can be understood. It should be noted, however, that for the purposes of the present invention, the tobacco handling apparatus 50 is to be considered a part of the tobacco transferring assembly 40.

When tobacco leaves 26 are discharged into the tobacco handling apparatus 50 by the second paddle structure 52*b,* they fall upon a conveyor belt 54 on the tobacco handling apparatus 50 which conveyor belt 54 extends transversely along the length of the paddle structure 52*b*. The conveyor belt 54 carries the tobacco leaves 26 to a pair of conveyor belts including a main conveyor belt and an auxiliary conveyor belt which cooperate to carry the individual tobacco leaves 26 upwardly toward a pair of distributing rollers which discharge the leaves through a flow path having a substantial maximum horizontal extent. The location of the main conveyor belt and auxiliary conveyor belt is generally indicated by the reference numeral 56 and the location of the distributing rollers is generally indicated by the reference numeral 58.

A tobacco curing bin, generally designated 60, is best seen in phantom in FIG. 2 and is disposed such that its horizontal extent is positioned to receive the tobacco leaves 26 discharged by the tobacco handling apparatus 50. A leaf distributing mechanism, generally designated 62 and shown schematically in phantom lines in FIG. 2, is provided to ensure that the individual tobacco leaves 26 discharged by the tobacco handling apparatus 50 are distributed evenly within the tobacco curing bin 60. The details of the structure and operation of the leaf distributing mechanism are completely described and disclosed in the '745 patent reference and in the U.S. Pat. No. 4,379,669 and, because these two patent references have been incorporated by reference in their entirety into the present application, these details will not be repeated here. Certain features of the leaf distributing mechanism 62, however, will be pointed out and assigned reference numerals so that the manner in which the leaf distributing mechanism 62 is incorporated into the tobacco transferring assembly 40 of the present application can be easily understood by one skilled in the art.

As the incorporated U.S. Pat. No. 4,379,669 and '745 patent references make clear, the leaf distributing mechanism 62 includes a baffle structure 64 which reciprocates along and/or oscillates across the flow path of the individual tobacco leaves 26 as they are discharged from the distributing rollers 58 of the tobacco handling apparatus 50 so that the individual tobacco leaves 26 are distributed substantially uniformly along the longitudinal and transverse extent of the tobacco curing bin 60. The baffle structure 64 is supported on a carriage 67 which is mounted on a first frame 69. The first frame 69 is mounted on a shaft 75 within a stationary second frame 71 for oscillatory, pivotal movement of the first frame with respect to the second. The carriage is rollingly mounted on the first frame 69 for reciprocal movement with respect thereto as the first frame 69 oscillates with respect to the second frame 71. The details of the mechanical structure necessary to effect this reciprocal and/or oscillatory movement of the baffle structure 64 are completely disclosed in the '745 patent reference and in the U.S. Pat. No. 4,379,669 and, because this disclosure is incorporated herein by reference, these details will not be repeated in the present application.

Figure 3:
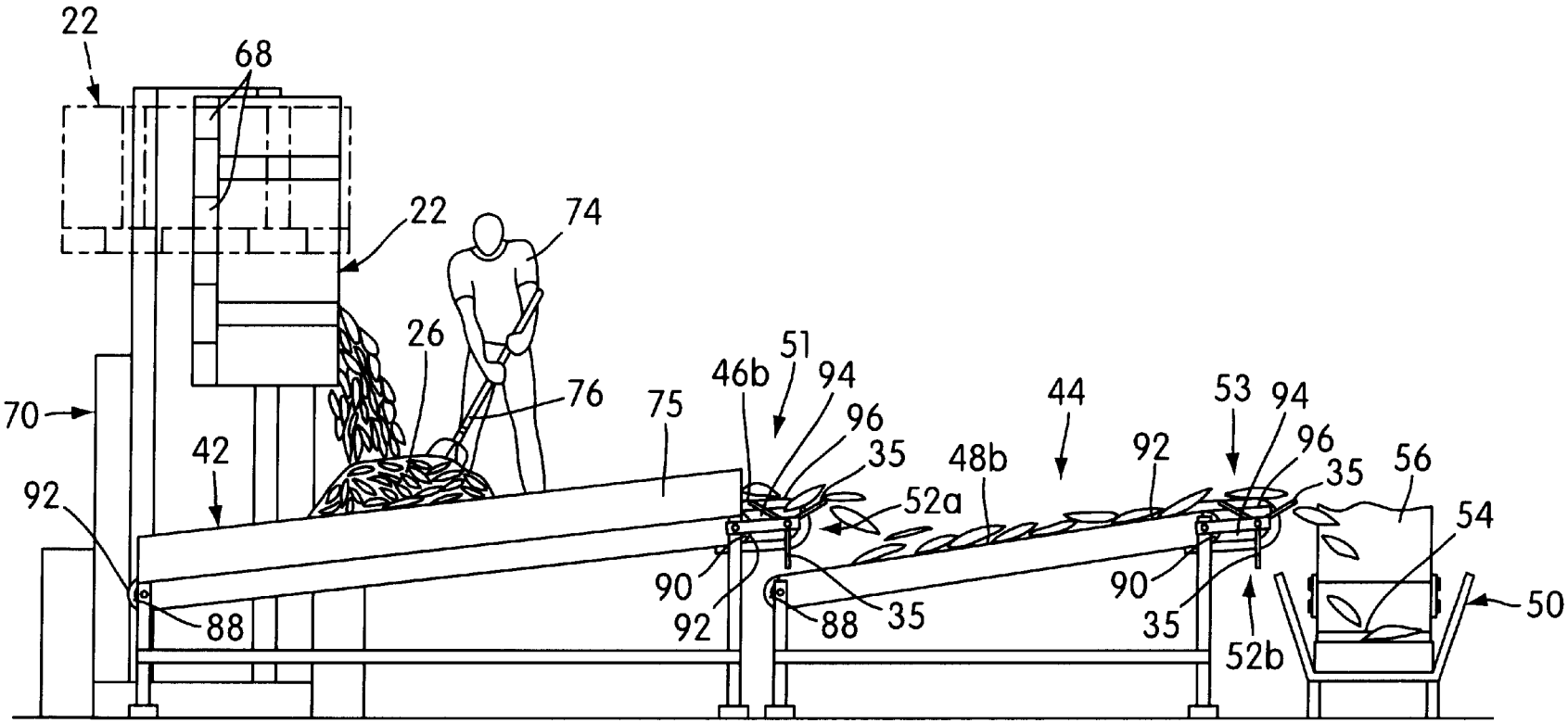
FIG. 3 is a fragmentary elevational view of a portion of the tobacco processing assembly of FIG. 2 showing a worker manually dispersing a mass of harvested tobacco leaves on a first conveyor assembly of the tobacco processing assembly from the wooden crate structure shown in a first position in phantom lines and a second position in solid lines on a conventional forklift.

Additional structural details of the tobacco transferring assembly 40 are shown in FIG. 3. It can be appreciated that each conveyor assembly 42, 44 is slightly inclined from a first end thereof to the leaf discharge end 51, 53, respectively, thereof. The drive means for the conveyor assemblies 42, 44 is not shown in FIGS. 3 or 4 to more clearly show the structures illustrated therein. Each conveyor belt structure 46*a* (not shown), 46*b* and 48*a* (not shown), 48*b* has a first transversely extending roller member 88 and a second transversely extending roller member 90 mounted in a conventional manner to the conveyor assemblies 42, 44. These rollers 88, 90 support the first and second ends of a conventional conveyor belt 92 which is in the form of a closed loop. Each second roller member 90 is mechanically coupled in a convention manner to a drive means. The axle structure 31 of each paddle structure 52 is rotatably mounted to the respective conveyor assembly 42, 44 proximate the end of the respective conveyor belt structure 46, 48 and is rotatably supported at the center thereof by a support structure 94 at the center of the discharge end 51, 53 of each conveyor assembly 42, 44. A housing structure 96 at the end of each conveyor assembly 42, 44 contains the mechanical means for rotationally coupling the driven second roller member 90 with the axle 31 on each assembly. In the embodiments shown, a plurality of conventional gear structures (not shown) within the housing structure 96 are used in a manner well known in the art to rotationally couple each axle and the second roller member associated therewith.

As will become clear when the operation of the tobacco transferring assembly 40 is discussed below, the assembly 40 generally operates by receiving relatively densely packed, randomly arranged amorphous leaf masses on the first conveyor assembly 42, separating the masses of tobacco leaves 26 into individual leaves as they pass over the first and second conveyor assemblies 42, 44 and then uniformly distributing the separated tobacco leaves 26 in the curing bin 60 by discharging the leaves through the distributing rollers 58 of the tobacco handling apparatus 50 over the curing bin 60 and deflecting them into the same by the regular reciprocal and oscillatory movements of the baffle structure 64.

The tobacco curing bin 60 can be of the type which is received within a curing barn arrangement such as disclosed in U.S. Pat. No. 3,948,553 issued Apr. 6, 1976 to Charles W. Suggs which patent is incorporated herein in its entirety; or, the curing bin 60 can be of the type in which the bin 60 itself forms part of the curing barn arrangement. An example of the latter is disclosed in the U.S. Pat. No. 4,136,465 issued Jan. 30, 1979 to Robert W. Wilson which patent reference is incorporated in the present application in its entirety. The bin can also be of the type described in the incorporated '745 patent.

Although it is preferred to transfer the leaves to a curing bin for transfer to a curing barn, is also within the scope of the present invention to direct the individual tobacco leaves 26 into a tobacco curing rack as they are discharged from the distributing rollers 58. An example of an appropriate tobacco rack is disclosed in U.S. Pat. No. 3,244,445 to R. W. Wilson issued Apr. 5, 1966, U.S. Pat. No. 3,134,583 to R. W. Wilson issued May 26, 1964 and U.S. Pat. No. 3,083,517 to R. W. Wilson issued Apr. 2, 1963 which patents are hereby incorporated into the present application in their entirety. It is also contemplated to use a mechanism for directing the leaves into a curing rack as part of the tobacco processing assembly 40 as disclosed in the U.S. Pat. No. 4,379,669 patent reference which has been incorporated herein in its entirety and so a detailed discussion of the same will not be undertaken in the present application.

After the tobacco leaves have been properly distributed in an appropriate container, as, for example, either a curing bin 60 or a curing rack, the leaves 26 are then typically transported to a curing barn for curing. An example of an appropriate curing barn and method for curing the tobacco leaves 26 therein is described in U.S. Pat. No. 4,424,024 to Robert W. Wilson and Olin C. Trull issued Jan. 3, 1984, U.S. Pat. No. 4,136,465 to Robert W. Wilson issued Jan. 30, 1979, U.S. Pat. No. 3,927,683 to Robert W. Wilson and Eugene T. Akins issued Dec. 23, 1975, U.S. Pat. No. 3,664,034 to Robert W. Wilson issued May 23, 1972 and U.S. Pat. No. 3,503,137 to Robert W. Wilson issued Mar. 31, 1970 which patents are hereby incorporated into the present application in their entirety.

Operation

The conveyor belt assemblies 42, 44 comprise a system of conveyor belts which supply an essentially continuous flow of single tobacco leaves to the tobacco handling apparatus 50 which, in turn, directs the leaves 26 in a known manner to the curing bin 60. The tobacco leaves 26 are typically transported to the processing site in bulk; in the exemplary system shown in the figures, the harvested bulk tobacco leaves 26 are transported to the tobacco transferring assembly 40 in crate structures 22 on the flat bed truck 20. The tobacco leaves 26 within the crate structures 22 are typically relatively densely packed together because tobacco leaves are generally large, flat, rather flaccid and have large surface areas. Consequently, the leaves 26 tend to stick together to some degree. The harvesting process also tends to randomly orient the leaves within the collection receptacle 28 and these randomly oriented leaves 26 tend to form an amorphous leaf mass. It is desired to place them in the curing bin 54 so that the leaf surfaces thereof are essentially parallel, the leaves are relatively loosely and uniformly packed and evenly distributed. It is therefore desirable to separate these amorphous leaf masses which arrive for processing at the processing site into individual leaves before directing them toward the curing bin or other container which supports the leaves for curing. As will become apparent, the first and second conveyor belt assemblies 42, 44 separate and disperse the leaf masses into individual leaves and provide the tobacco handling apparatus 50 with a continuous stream of individual tobacco leaves 26 which are then projected horizontally outwardly over the curing bin 60.

As shown in FIG. 3, the crate structures 22 are provided with conventional slots 68 to receive the tines of a conventional fork lift 70. The crate structures 22 are taken by forklift from the flat bed truck 20 to the first conveyor assembly 42. The forklift may operate in pairs when large quantities of bulk leaves are to be processed. The fork lift operator elevates the crate structure 22, places the same in position to empty all or a portion of the amorphous leaf mass 26 contained therein into the approximate center of the first conveyor assembly 42 and rotates the crate structure 22 in a manner that tends to invert the crate structure 22 to deposit the tobacco leaves 26 on the first conveyor assembly 42. The crate structure 22 is typically rotated over 90 degrees, but is usually rotated in stages, not in one continuous movement. Depending upon the amount of leaves in the crate 22, their density and the surface area of the conveyor assembly surface 55, the fork lift operator may temporarily halt the rotation of the crate structure 22 when a sufficient volume of leaves 26 is on the first conveyor assembly 42. When the first conveyor assembly 42 is ready for more leaves, the fork lift operator continues to rotate the crate structure 22 through the full range of over 90 degrees which empties the leaf contents of the crate structure 22 onto the first conveyor assembly 42.

The conveyor belt structures 46, 48 are typically rotating as the tobacco leaves 26 are being placed on the first conveyor assembly 42 from the crate structure 22. One or two workers 74 with conventional hand tools such as pitch forks 76 or rakes (not shown) manually spread the central leaf mass evenly over the surface of the first conveyor assembly 42 as the conveyor belt structures 46 are moving. Short wall portions 75 are provided which extend the length of the conveyor assembly 42 which confine the leaves 26 on the conveyor assembly surface 55. The workers 74 can stand on the ground beside the first conveyor assembly 42, on a non-moving portion of the conveyor assembly 42 or directly on the moving conveyor belts 46*a* or 46*b* because the rotational speed of the belts 46 (and the belts 48) is constant and relatively slow.

The workers 74 manually redistribute the leaf mass so that the leaf mass is relatively thin, for example 1 to 5 leaves thick, as the leading edge of the leaf mass on the first conveyor assembly 42 engages the first paddle structure 52*a*. Each paddle 52 rotates at a approximately the same rate as the conveyor belt 46, 48 associated therewith or preferably slightly faster. The rotational speed of the paddle structures 52 can be controlled by selecting an appropriate gear ratio between a driven second roller member 90 and the axle 31 when the conveyors 42, 44 are constructed. The blades 35 thereof are generally comprised of a rubber-like compound which readily frictionally engages any leaf surface that contacts the same. It can be appreciated that the rotating blades 35 of the paddle structure 52*a* tend to separate the bottom layer of leaves of the thin moving leaf mass on the first conveyor assembly 42 from the overlying leaves and to discharge this bottom layer outwardly onto the second conveyor assembly 44. It can be understood that the rotation of the paddle structure 52*a* of the conveyor belts 46 also provides a flailing action on the leaves which tends to breakup and separate the layered leaves 26 on the first conveyor assembly 42 to provide a transverse array of essentially individual leaves to the second conveyor assembly 44.

The second conveyor assembly 42 is rotating at a rate approximately equal to the rotational rate of the first conveyor assembly 42 or slightly faster so that as an array of leaves 26 lands on a second conveyor assembly, they are displaced outwardly from the first conveyor assembly 42 to prevent or minimize the layering of leaves on the second conveyor assembly 44. Because of the thinness, large area, irregular shape, lightweight and flaccid characteristics of tobacco leaves, however, they do not follow a uniform path from the first conveyor assembly 42 to the second conveyor assembly 44. Consequently, some leaf layering will occur on the second conveyor assembly, but the leaves, once separated from one another remain separate and loose because no compressive force is applied to them. Because the leaves 26 from the crate structure 22 tend to stick together, they may be projected onto the second conveyor assembly 44 in pairs or in small clumps. The paddle structures 52 tend to separate these leaf masses and also tends to give the leaves a slight arcuate trajectory and this movement through the air also tends to separate the leaves somewhat.

The workers 74 can control the rotation of the conveyor belt assemblies 42, 44 so that they can immediately stop either conveyor 42 or 44 or both at their discretion. It can be understood that it may be necessary to temporarily halt the first or second conveyor assembly 42, 44 to provide an appropriate rate of leaf flow to the tobacco handling apparatus 50. The volume of the tobacco leaves 26 tends to increase somewhat as the leaves progress from the central mass in the center of the first conveyor assembly 42 to the initial even layering on the first conveyor assembly 42 which results from the manual spreading of the leaves by the workers 74 to the thin layering on the second conveyor assembly 44 because the leaves are progressively separated in stages from a clumped mass to individual leaves.

As the leaves advance along the second conveyor assembly 44 toward the paddle structure 52*b* associated therewith, typically no further manual manipulation of the leaves is necessary. The flailing action of the second paddle structure and the frictional force applied thereby to the leaf surfaces provides almost complete leaf separation. Hence, although it is within the scope of the present invention to provide a cascade of more than two conveyor assemblies, it is found that two is sufficient to provide leaf separation and single layering. The structure and function of the second paddle structure 52*b* is essentially the same as the first paddle structure 52a. The second conveyor belt structures 48*a*, 48*b* and the second paddle structure 52*b* cooperate to provide the transversely extending conveyor belt 54 of the tobacco handling apparatus 50 with an essentially continuous stream of individual tobacco leaves 26. Typically the conveyor belt structures 54, 56 on the tobacco handling apparatus 50 are continuously rotated and are not interrupted by the workers 74. The flow of tobacco leaves to and through the tobacco handling apparatus 50 and, therefore, to the curing bin 60 is controlled by starting and stopping the conveyor assemblies 42, 44 as appropriate in the judgment of a worker 74 monitoring the tobacco processing assembly 40.

The rotational rate of the transverse conveyor belt 54 of the tobacco handling apparatus 50 relative to the rotational rate of the second conveyor assembly 44 is sufficiently rapid to transversely displace the falling leaves toward the curing bin 60 to prevent significant layering or piling up of the leaves 26 in the tobacco handling apparatus 50. As described in the incorporated '669 patent reference, the leaves discharged from the tobacco handling apparatus 50 have sufficient velocity to propel them a predetermined horizontal distance over the curing bin 60 at a predetermined trajectory, preferably 11 degrees as described in the '669 reference. This movement of the leaves 26 through the air tends to separate leaves so that a continuous stream of individual leaves 26 strikes the baffle structure 64 of the leaf distributing mechanism 62. The leaf distributing mechanism 62 typically and preferably operates continuously as the leaves are being dumped onto the conveyor assembly 42 and separated on the conveyor assemblies 42, 44 and sent to the tobacco handling apparatus 50. Hence, even if the conveyor assemblies 42, 44 are temporarily halted, the mechanical leaf distributing mechanism 62 continues its reciprocal and oscillatory movements without interruption.

When the curing bin 60 is full, the leaf flow through the tobacco processing assembly 40 is halted by either stopping the conveyor assemblies 42, 44 or by refraining from introducing new leaf masses onto the conveyor assembly 42 from the crate structure 22 on the fork lift 70. As described in the incorporated patent references, when the curing bin is full, a cover is placed on the bin 60 and typically a plurality of rod structures are placed through the leaves 26 essentially perpendicular to the leaf surfaces. The curing bin 60 is then rotated 90 degrees so that the parallel leaves in the curing bin 60 are essentially perpendicular to the ground and the curing bin 60 is then usually placed in a curing barn (not shown) in close proximity to similar curing bins. As described in the above incorporated references directed to curing barns and methods, heated and conditioned air is typically forced through the parallel surfaces during curing.

Figure 4:
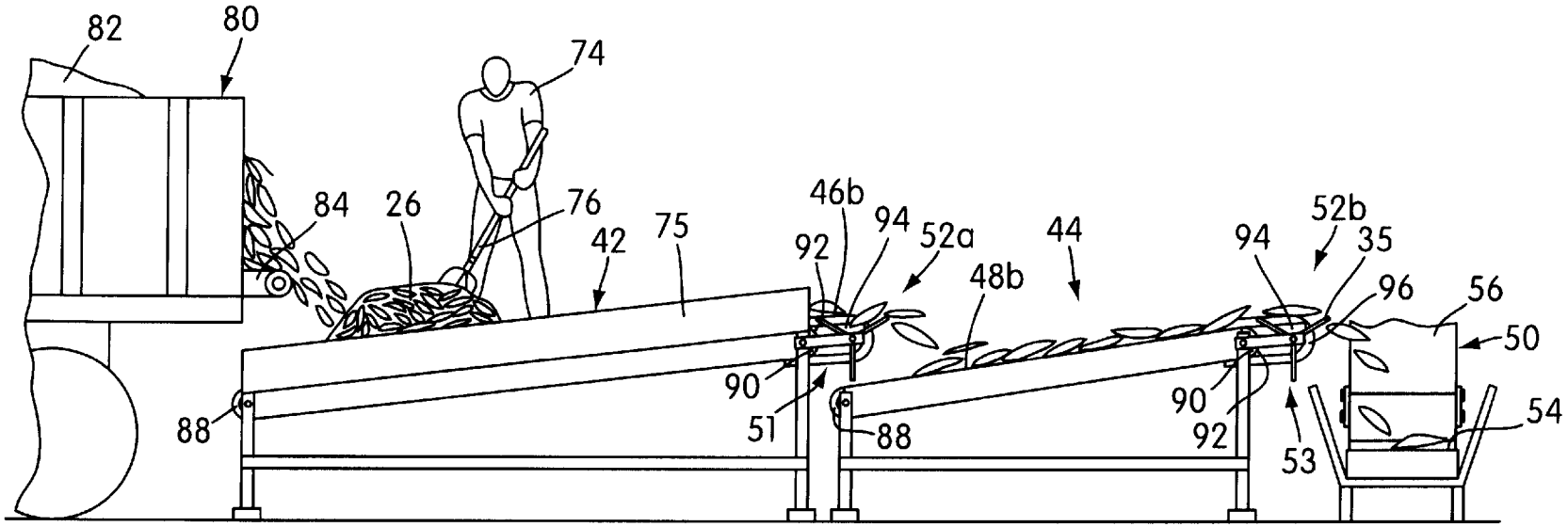
FIG. 4 is a fragmentary elevational view of a portion of the tobacco processing assembly similar to FIG. 3 and showing a flat bed truck with a conveyor belt bed as an alternative means for delivering leaves harvested in bulk to the tobacco processing assembly and of transferring the same to the first conveyor assembly.

As shown in FIG. 4 the amorphous mass of harvested tobacco leaves 26 can arrive for transfer to curing bins 60 in a single mass on a flat bed truck structure 80 shown in fragmentary view. The tobacco leaves 26 are not contained in crate structures 22 but rather are placed directly on the truck bed by the combine (now shown) at the harvest site. The leaves 26 are covered by a tarpaulin 82, by netting or by other appropriate covering material during transit from the harvest site to the tobacco processing assembly 40. The bed of the trailer portion of the truck structure 80 is a conventional conveyor belt 84 operable to move the leaves 26 off of the truck 80.

The truck 80 as shown in FIG. 4 is backed up to the first conveyor assembly 42 and the conveyor belt 84 supporting the leaf mass on the truck 80 is briefly actuated to place a desired amount of leaves on the first conveyor assembly 42. The conveyor belt 84 on the truck 80 is turned off to allow the leaf mass on the conveyor assembly 42 to be manually spread and transported to the second conveyor assembly 44.

One skilled in the art will appreciate that the movement of tobacco leaves 26 through the tobacco processing assembly 40 is a continuous process and typically the conveyor assemblies 42, 44 are in continuous operation. As the leaves progress through the assembly 40 to the curing bin 60, a new leaf mass is placed on the first conveyor assembly 42 from the conveyor belt 84 on the truck 80 (or from the crate structure 22 on the fork lift 70). Interruption of the leaf flow by turning off either conveyor assembly 42, 44 or both is typically infrequent but can occurs at the discretion of a worker 74 monitoring the tobacco processing assembly 40. An additional worker (not shown) may be stationed at the end of the second conveyor assembly 44 so that the tobacco handling apparatus 50 is between the worker and the second conveyor assembly 44. The worker can monitor the flow of leaves into the tobacco handling apparatus 50 and break up masses of leaves if necessary or otherwise manually regulate the flow of leaves off the moving or stationary conveyor assembly 44 onto the moving transverse conveyor belt 54 of the tobacco handling apparatus 50.

As disclosed and described in the U.S. Pat. No. 4,379,669, the tobacco handling apparatus 50 can be provided with appropriate structures to place the leaves 26 in a conventional tobacco rack. An example of such a rack and a description of the filling process is given in the U.S. Pat. No. 4,379,669 and is not repeated in the present application. One skilled in the art will appreciate that the transfer of the tobacco leaves from the collection receptacle on the combine to the rack or bin using the tobacco processing assembly 40 can be performed at any location including the harvest site or at the curing site. Therefore, although this transfer operation from the collection receptacle 28 on the combine 24 to the bin or rack is not part of the harvesting operation and is rather a separate subsequent step, it is within the scope of the invention to use the tobacco processing assembly 40 to transfer the leaves to the bin or rack at the harvesting site.

One skilled in the art will also recognize that the present application read with the incorporated patent references describes a number of different method and structures for supporting harvested tobacco leaves for curing. Specifically the leaves can be racked or placed in curing bins on the combine as described in the '745 patent reference or the tobacco can be collected in bulk as an amorphous mass in the collection receptacle of the combine and this amorphous mass of leaves can then be transferred to appropriate leaf support structures in a second step. This second step can be accomplished through the use of the conveyor assemblies 42, 44 which provide a stream of leaves to the tobacco handling apparatus 50, which, in turn can discharge them into a rack as described in the U.S. Pat. No. 4,379,669 or into a curing bin as described in the U.S. Pat. No. 4,379,669 and '745 references.

It can be appreciated that the method of transferring the leaves from collection receptacles on the combine to curing bins is largely mechanized although a minimum amount of manual labor is required and some intelligent human monitoring in control of the operation is also required. The leaf transfer system described herein minimizes the amount of manual handling of the leaves during leaf transfer.

It can thus be seen that the objectives of the present invention have been fully and effectively accomplished. It should be realized, however, that the foregoing preferred specific embodiment has been shown and described for the purpose of illustrating the structural and functional principles of the present invention and is subject to change without departure from such principles. Therefore, this invention includes all modifications, alterations, and substitutions encompassed within the spirit and scope of the appended claims.

It should be noted that the appended claims do not have limitations phrased in the "means or step for performing a specified format" permitted by 35 U.S.C. §112, paragraph 6. This is to make clear that the appended claims arc not to be interpreted under §112, paragraph 6 as being limited solely to the structure, material, or acts described in the present application and their equivalents.

What is claimed:

1. A method for transferring uncured substantially whole harvested tobacco leaves from an amorphous mass of harvested uncured substantially whole tobacco leaves contained in a tobacco containing structure to a bulk curing container component for subsequent curing, said method comprising:

positioning the bulk curing container component adjacent a tobacco discharging end of a tobacco transferring system, the transferring system having the discharging end, a tobacco receiving end opposite the discharging end, and a generally upwardly facing tobacco conveying apparatus for supporting and conveying the leaves between said discharging and receiving ends;

supplying the amorphous mass of harvested uncured substantially whole tobacco leaves from the tobacco containing structure to the tobacco conveying apparatus at the tobacco receiving end of the transferring system in such a manner that the harvested uncured substantially whole tobacco leaves of the amorphous mass are randomly arranged and in a vertically stacked condition on top of one another; and continuously operating said transferring system under power such that said transferring system (a) conveys the harvested uncured substantially whole tobacco leaves from the tobacco receiving end thereof to the tobacco discharging end thereof and then subsequently discharges the conveyed uncured substantially whole tobacco leaves from the discharging end thereof to the bulk curing container component with the tobacco conveying apparatus supporting and conveying the harvested uncured substantially whole tobacco leaves supplied thereto in said vertically stacked condition away from said tobacco receiving end at a first speed and (b) separates said uncured substantially whole tobacco leaves supplied in said vertically stacked condition and disperses the uncured leaves along said tobacco conveying apparatus as the leaves are being conveyed thereby to reduce the vertically stacked condition of the uncured leaves so that the uncured leaves are discharged from the discharging end thereof as a substantially continuous stream of uncured substantially whole tobacco leaves in a separated condition moving at a final speed greater than said first speed.

2. A method according to claim 1, wherein the separation and dispersion of the uncured leaves along said tobacco conveying apparatus is accomplished during a downward movement of the uncured leaves being conveyed by said tobacco conveying apparatus through the air between speed changes.

3. A method according to claim 2, wherein the uncured leaves being conveyed along said tobacco conveying apparatus are paddled prior to their movement downwardly through the air to facilitate separation during the downward movement.

4. A method according to claim 3, wherein the uncured leaves being discharged as a substantially continuous stream from the discharging end as aforesaid are discharged therefrom with sufficient speed and at a trajectory to propel the stream over said container component and wherein said stream is distributed into said container component utilizing a leaf distributing mechanism moving with a reciprocating and oscillating movement over said container component.

5. A method according to claim 4, wherein said bulk container component comprises a bulk curing bin.

6. A method according to claim 5, wherein said bulk curing bin comprises forms part of a curing barn.

7. A method according to claim 1, wherein said tobacco conveying apparatus supports and conveys the uncured leaves at a plurality of progressively increasing speeds as the uncured leaves are conveyed therealong.

8. A method according to claim 7, wherein said separation and dispersion of the uncured leaves along said tobacco conveying apparatus is accomplished during a downward movement of the uncured leaves being conveyed by said tobacco conveying apparatus through the air between speed changes.

9. A method according to claim 8, wherein the uncured leaves being conveyed along said tobacco conveying apparatus are paddled between one or more speed changes prior to their movement downwardly through the air to facilitate separation during the downward movement.

10. A method according to claim 1, wherein said amorphous mass of harvested uncured substantially whole tobacco leaves are contained in a containing structure on a vehicle, said containing structure including a conveyor belt assembly constructed and arranged to support said uncured substantially whole tobacco leaves in said containing structure and being power operable to transfer said uncured substantially whole tobacco leaves to the receiving end of said transferring system.

11. A method according to claim 10, wherein said uncured substantially whole tobacco leaves move downwardly through the air when being transferred from said conveyor belt assembly of said containing structure to the receiving end of said transferring system.

* * * * *